United States Patent [19]

Mumford

[11] Patent Number: 4,709,825

[45] Date of Patent: Dec. 1, 1987

[54] PRESS-ON TWIST-OFF CLOSURE FOR CONTAINER

[75] Inventor: George V. Mumford, Ventura, Calif.

[73] Assignee: Owens-Illinois Closure Inc., Toledo, Ohio

[21] Appl. No.: 418,366

[22] Filed: Sep. 15, 1982

[51] Int. Cl.[4] ..... B65D 41/16

[52] U.S. Cl. ..... 215/318; 215/334; 215/343; 215/350

[58] Field of Search ..... 215/318, 329, 330, 334, 215/341, 343, 345, 350

[56] References Cited

U.S. PATENT DOCUMENTS

| | | | |
|---|---|---|---|
| 2,058,214 | 10/1936 | Cohn | 215/334 |
| 2,965,256 | 12/1960 | Yochem | 215/329 |
| 3,215,297 | 11/1965 | Acton et al. | 215/343 |
| 3,232,470 | 2/1966 | Gibson | 215/329 |
| 3,270,904 | 9/1966 | Foster et al. . | |
| 3,371,813 | 3/1968 | Owen et al. . | |
| 3,448,881 | 6/1969 | Zipper . | |
| 3,559,833 | 2/1971 | Alonso | 215/329 |
| 3,606,062 | 9/1971 | Frisch et al. . | |
| 3,685,677 | 8/1972 | Westfall | 215/318 |
| 3,690,497 | 9/1972 | Lecinski, Jr. | 215/318 |
| 3,741,423 | 6/1973 | Acton et al. | 215/318 |
| 4,008,825 | 1/1977 | Westfall | 215/318 |
| 4,244,480 | 1/1981 | Planas | 215/334 |
| 4,280,632 | 7/1981 | Yuhara | 215/334 |

FOREIGN PATENT DOCUMENTS

| | | | |
|---|---|---|---|
| 2833099 | 2/1980 | Fed. Rep. of Germany | 215/318 |

*Primary Examiner*—Stephen Marcus
*Assistant Examiner*—David T. Fidei
*Attorney, Agent, or Firm*—H. G. Bruss

[57] ABSTRACT

An all-plastic press-on, twist-off closure for a container having threads in the neck finish is made of a hard plastic shell having a top and a peripheral skirt. A gasket member is provided on the inside of the shell located adjacent the top and the shell skirt. The gasket member has resilient deformable ribs for engaging the threads and the gasket member and the shell skirt are held together against rotation with respect to each other by interlocking spline means on the shell skirt and the gasket member skirt.

16 Claims, 6 Drawing Figures

PRESS-ON TWIST-OFF CLOSURE FOR CONTAINER

The present invention relates to thermoplastic closures for containers having threads on the neck thereof, the closure consisting of a hard plastic shell having a top and a peripheral skirt and a gasket material disposed on the inside of the top and the skirt for engaging the threads and neck of the container.

BACKGROUND OF THE INVENTION

It is desirable to provide a plastic closure with a press-on screw-off structure that is adapted for high speed production, for easy use on containers, and well adapted for vacuum capping operations. It is also desirable to provide a plastic closure having sealing and retention functions that can be optimized by selection of proper thermoplastic materials for such sealing and retention functions.

In the past, for example, in U.S. Pat. No. 3,371,813 (Owen et al) there is proposed a closure with a soft, readily deformable gasket material inside the pheripheral skirt of a metal closure, the gasket material being said to deform readily and flow around the threads of a container to form cooperating thread grooves in the gasket material. This formation of well defined, cooperating set grooves in the gasket for contact with the ribs, the grooves providing leverage on the threads to permit opening of the container by twisting the metal cap. The gasket material is said to be cast in situ on the skirt and in the side of the top of the closure to form a liner. The patent also suggests that the resilient deformable gasket material have ribs that are at least 20% and generally 30% to 70% of the total circumferential surface area of the gasket skirt to provide increased package security and greater cam off force against the continuous or discontinuous threads of the container.

U.S. Pat. No. 4,000,825 (Westfall) describes a press-on twist-off metal closure of the type described in the above Owen et al patent for oxygen sensitive products. The patent describes a top liner having spaced-apart vertical ribs inside the skirt of the shell of the closure. The liner is formed preferably from a foamed plastisol material that deforms and cold flows around the threads of the neck of a container to form a series of thread-cooperating cavities in the foamed liner to aid in removal of the closure using a twist-off motion. In addition, the patent shows a top seal as well as the sealing obtained by deformation of the gasket material around the threads.

In U.S. Pat. No. 3,270,904 (Foster et al) there is a press-on turn-off metal cap, the cap having a gasket material at the top and around the bottom of the skirt, the gasket material in the skirt engaging the threads of the container. The gasket material is described as a plastomeric and takes a conformation to form a hermetic seal cooperating with the thread means of the container finish. The plastomeric material hardens to form rigid thread grooves therein for the camming operation with the raised threads of the neck of the container.

U.S. Pat. No. 3,606,062 (Frisch et al) discloses a crimp-on twist-off metal crown cap with top and corner seals. There are deformable metal flutes in the metal shell to engage the threads of the container.

U.S. Pat. No. 3,448,881 (Zipper) discloses a metal closure with a gasket for engaging the threads of a container, the metal closure having means to prevent increase in cap removal torque including a ridge on the underside of the cap to prevent settling of the cap due to gradual deformation of the gasket material. Grooves are formed in the gasket by the threads of the container when the metal cap is applied to the threads. In FIG. 5 of the Zipper patent, a series of dimples 41 are provided in the top wall of the cap. However there is no suggestion of interengaging parts that dovetail together for a strong locking force in the skirt area of the cap.

In general, in the above patents that describe metal caps with soft deformable gaskets, there is substantial contact between the deformable gasket ribs and the container threads such as contact of the entire rib or as, for instance, in the Owen et al patent, the ribs are shaped for substantial contact with the threads and comprise 20% up to 70% of the gasket area.

It is an object of the present invention to provide an all-plastic closure for a container, the closure comprising a hard plastic shell with a top and a skirt and a deformable plastic gasket material as a liner inside the top and as a gasket material located on the inside skirt of the shell, the gasket and the shell being so constructed and arranged that when the gasket is formed inside the shell, there is no rotation of the gasket with respect to the shell.

It is an object of the present invention to provide a closure for a container, the container comprising a neck finish area with generally helical threads, the closure comprising a thermoplastic cap having a top and a peripheral skirt, a gasket member of resilient plastic located next to the shell of the cap, the gasket member including a skirt located just inside and concentric with the shell of the skirt, there being a plurality of ribs in the gasket material on the inside thereof for deformation around the threads of the container when the cap is closed over the threads, the area of all the ribs being less than about 10% of the circumferential surface area of the gasket skirt, there being sufficient ribs to adequately retain the cap when subject to normal abuses in shipping and handling, the gasket material and cap shell being held together by spline means including spaced-apart vertical splines and corresponding cooperating grooves in the cap skirt and in the gasket member that are like gear teeth so that the gasket member and shell will not rotate with respect to each other.

It is an object of the present invention to provide a thermoplastic closure for a container having threads in the neck area, in which there is a deformable portion in the skirt of the cap that will deform to the contour of at least a portion of the threads when the closure is pressed on and in which there is spline means for dovetailing the deformable portion and the shell skirt together so that the deformable portion does not rotate with respect to the shell.

It is an object of the present invention to provide a thermoplastic closure comprising a plastic shell and an inner deformable gasket to engage a container having threads, the closure being easy to manufacture, easy to decorate, easy to use and the shell and gasket being held together by dovetail means to prevent rotation, the resulting closure being accommodating of finish irregularities and being capable of seal and retention function optimization.

These and other objects will be apparent from the specification that follows, the appended claims, and the drawings in which:

THE INVENTION

The present invention provides an economical thermoplastic closure for a container, the closure being easy to manufacture and easy to place on the container in a vacuum capping production operation. The resultant closure accommodates irregularities of finish and provides for seal and retention function optimization. The all-plastic construction provides a closure that is easily decorated. The resultant closure is generally more pleasing to the eye than a metal closure and, in addition, is more economical.

The present invention provides a closure for a container, the container comprising a neck finish area with generally helical threads, the closure comprising a cap having a top and a peripheral skirt and a deformable gasket, the gasket being located next to the shell of the cap, the gasket including a skirt located just inside and concentric with the shell skirt, there being a plurality of the spaced-apart generally vertical ribs in the gasket material on the inside thereof for deformation around the threads of the container when the cap is closed over the threads, the area of the ribs being less than about 10% of the circumferential area of the gasket on the skirt, there being sufficient ribs spaced apart to adequately retain the cap on the container when subject to abuses from shipping and handling, the plastic gasket material and cap shell being held together by interengaging means including spaced-apart vertical splines and corresponding cooperating grooves in the cap skirt and in the gasket so that the gasket will not rotate with respect to the shell.

The present invention also provides the closure as described above, in which the gasket is in two pieces, one piece located substantially next to the top of the cap, and the other piece being located along the skirt portion of the gasket and containing the above-described spaced-apart ribs for a deformable contact with the threads of the container.

Figure 1:
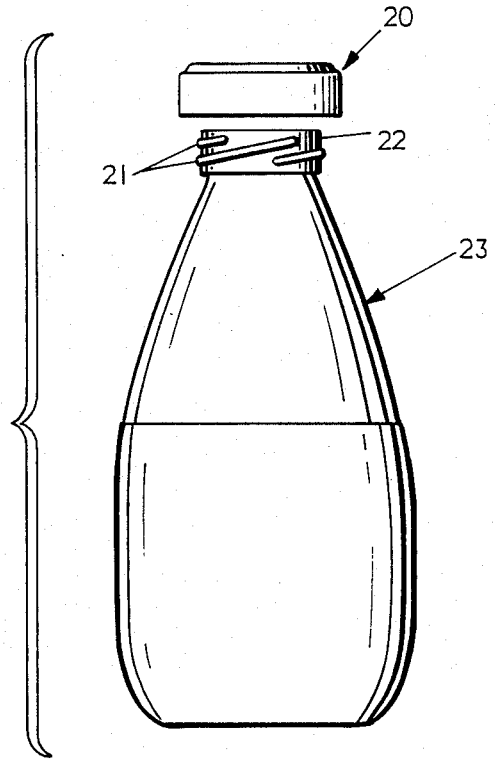
FIG. 1 is an exploded view of a container having helical threads in the neck area, and a closure therefor embodying the present invention.
Figure 2:
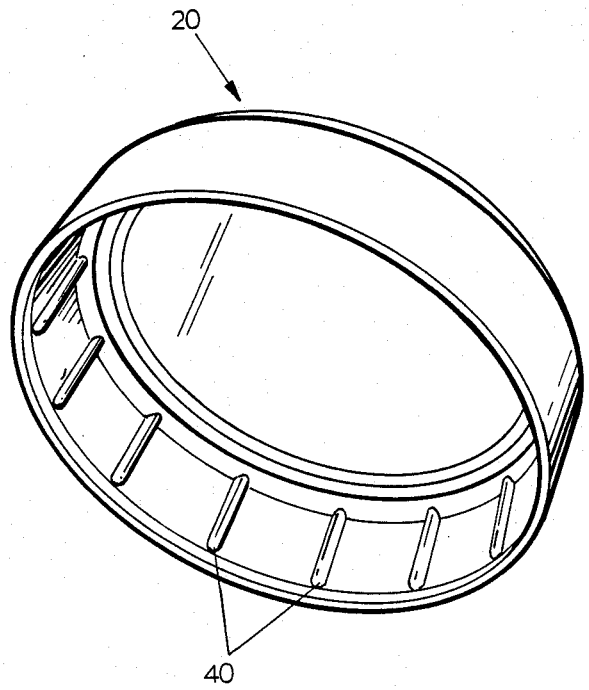
FIG. 2 is a perspective view of the inside of the closure showing the inside bottom of the closure of the present invention showing the spaced-apart, flexible, deformable gasket material on the cap skirt with deformable ribs.

As shown in the drawings and particularly as seen in FIG. 1, a thermoplastic closure 20 is provided for engaging the threads 21 of a neck finish area 22 of a container 23. As is, for instance, seen in FIGS. 2, 3, and 4, the closure comprises a hard, flexible, thermoplastic cap shell that is preferably made of high density polyethylene, the shell having a top wall 33 and a peripheral skirt 34. The peripheral skirt 34 has a plurality of spaced-apart generally vertical splines 36 that dovetails with corresponding grooves 37 of a resiliant gasket 38 that is a liner for the cap shell. The liner 38 has a top wall 39*a* next to the top wall 33 of the cap shell that serves as a top seal and a top side seal. The gasket material has a peripheral skirt 39*b* having a plurality of spaced-apart generally resiliant deformable ribs 40 that are preferably made from a polyvinyl chloride plastisol material that results in a flexible foamed polyvinyl chloride gasket. The total area of the ribs 40 is generally less than about 10%, say in the order of about 1% to 8%, of the circumferential area of the gasket on the skirt. One of the preferred configurations of the rib is shown as ribs 40 in the drawings. Each rib 40 has a width that is about the same throughout its length, the ribs generally being narrow and the height of the ribs (projection from the skirt) is generally about the same from top to bottom. The area occupied by the ribs 40 is under about 10% and preferably about 5–8% of the total circumferential area of the skirt.

Figure 3:
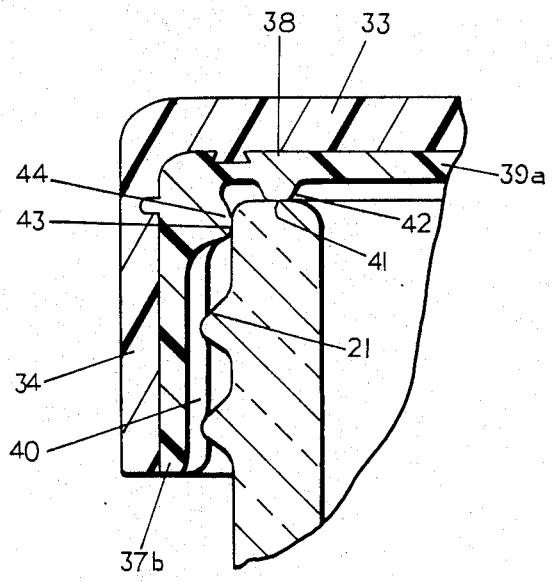
FIG. 3 is a fragmentary sectional view of the closure taken on an enlarged scale.

As best seen in FIG. 3, the gasket provides a top seal 41 at the top of the glass container by means of a projection 42. The gasket also provides a top side seal at 43 by means of a projection 44 from the gasket material that seats itself on the outside of the neck of the container such seals being able to accommodate irregular and somewhat rough finishes without impairing the sealing and retaining function of the closure.

Figure 4:
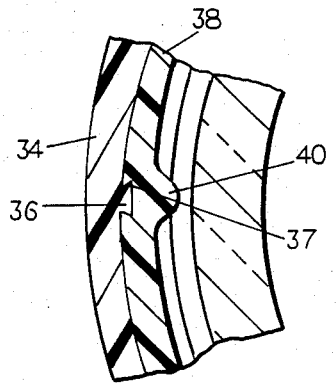
FIG. 4 is a fragmentary plan view of the closure showing engagement of the ribs of the gasket and the threads of the glass container on an enlarged scale.
Figure 6:
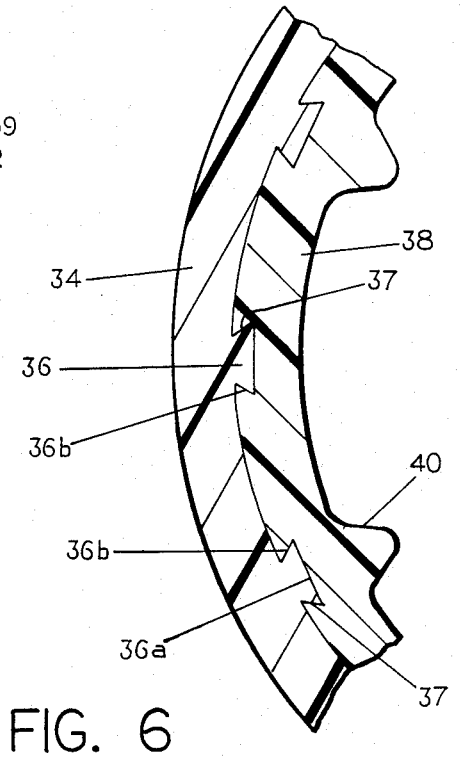
FIG. 6 is a fragmentary enlarged plan view of the shell and the gasket showing the interlocking spline means so that the gasket will not rotate with respect to the shell.

As is well know in the art, the gasket, which is preferably a foamed polyvinyl chloride plastisol, is cast in situ on the cap shell, the gasket taking a configuration shown in the drawings including that of the deformable resilient foamed ribs 40. The dovetail splines 36 and grooves 37 provide means of holding the gasket and shell together so as to prevent rotation with respect to each other. The splines and the corresponding cooperating grooves in the gasket are best shown in FIGS. 4 and 6, the dovetail splines being for antirotation and retaining of the gasket in place in the closure. As indicated in the drawings, the ribs 40 are relatively soft, resilient and deform around the threads to form set cooperating grooves whereby enough pressure can be applied against the threads to remove the closure.

As seen in FIG. 6, a plurality of splines 36, project inwardly from the cap skirt 34, such splines preferably having a top 36*a* and an undercut side portion 36*b* for interengagement with corresponding grooves 37 that are formed in the deformable gasket. The gasket material is formed into, for example, the shape shown in FIG. 6, the gasket material then sets to form the grooves 37 that dovetail with the splines 36. Depending upon the size of the closure, generally about six to sixteen and preferably about eight to twelve splines are employed to keep the gasket from rotating with respect to the skirt.

Figure 5:
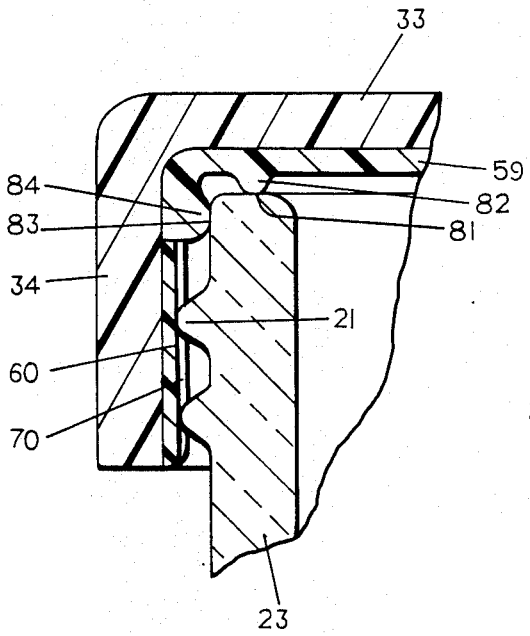
FIG. 5 is a fragmentary sectional view of another embodiment of the closure of the present invention, the gasket being in two parts.

As seen in FIG. 5, another embodiment of the closure of the present invention is shown, the closure comprising a hard plastic shell that has a top wall 33 and a pheripheral skirt 34 the same as the closure of FIGS. 1 through 4. The gasket material is provided in two pieces, one being an upper gasket 59 and the other piece being a lower gasket 60, the lower gasket being concentric to and adjacent to the cap shell skirt and containing thereon deformable resilient ribs 70 for engagement with the threads 21 of the container 23 in a manner like that of the ribs 40 of FIGS. 1 through 4. The top piece of the gasket has a top seal 81, the projection 82 contacting the top rim of the container. A top side seal at 83 is provided by the projection 84 contacting the top edge of the container rim that operates in substantially the same manner as the one-piece gasket material with seals at 41 and 43 as seen shown in FIGS. 1 through 4. The gasket piece 60 is held in place against rotation by the use of vertically spaced-apart splines in the cap shell and cooperating grooves in the gasket the same way that the gasket 38 is held in place in FIGS. 1 through 4 and 6.

When the closure 20 is pushed on the container 23, the cap skirt is flexed and forced outwardly, especially during warm capping operations. The plastic memory of the all-plastic shell tends to return the skirt to its original dimension and provides some force against the container threads to deform the ribs of the gasket skirt. When the closure is removed, the cooperating grooves are set and do not smooth out even over a relatively long time period.

It is preferred that the cap shell be made of high density polyethylene having a specific gravity of about 0.942 to 0.965, a tensile modulus of about 66,000 to 180,000 psi and a melt viscosity at 190° C. of about 7,000 to 120,000 poises. Other properties of the preferred high density material include a hardness of Shore A durometer of about 40 to 80, an impact resistance of about 0.6 to 20 (Izod impact foot pounds/inch of notch—1 inch thick specimen), tensile strength at break of about 3,000 to 6,000 psi, tensile yield strength of about 2,000 to 4,000 psi and a compressive strength (rupture or yield) of about 2,700 to 3,600 psi, and a melt flow index of about 0.2 to 8.

Although high density polyethylene is highly preferred for the cap shell material, other suitable polyolefins include low density polyethylene, polypropylene and polybutylene.

Although foamed polyvinyl chloride from a plastisol formulation is preferred for making the gasket in situ, other suitable gasket materials include foamed polypropylene, foamed polyethylene, and foamed copolymers of ethylene and vinyl acetate.

A preferred closure is one in which the shell is made from high density polyethylene, for instance, having a specific gravity of 0.95, a crystallinity of about 65% to 75%, a melt flow index of 0.6 and a number average molecular weight of about 10,000 to 20,000. Preferably used with the above high density polyethylene cap shell, is a flexible polyvinyl chloride foam material that can be easily cast in situ on the cap shell at a low enough temperature that the shell will not be distorted or degraded. A typical formulation for the plastisol material includes the following ingredients in parts by weight:

| Ingredient | Parts by Weight |
|---|---|
| Polyvinyl Chloride homopolymer or copolymer of 5–15% vinyl acetate or methyl acrylate with about 85–95% vinyl chloride | 100 |
| Plasticizer such as butylbenzl phthalate | 60–80 |
| Filler such as calcium carbonate | 1–2 |
| Lubricant | 3–5 |
| Pigment, such as $TiO_2$ | 1–2 |
| Blowing agent such as N, $N^1$—dimethyl-N, $N^1$ dinitroso terephthalamide | ½–2 |
| Stabilizer (Ca—Zn type) | 1.5–2.5 |

The polyvinyl chloride foamed material generally has a Shore A hardness of about 40–80, a density of about 0.8 to 1.2 g/cc and a rebound property such that about 50–70% of the compression imposed rebounds when the compressive force is released.

As is well known in the art, various stabilizers, fillers, lubricants, and plasticizers can be used along with a blowing agent for the flexible polyvinyl chloride foam, the blowing agent providing gas at the processing temperatures to form a generally closed cell structure.

The resultant closure is easy to manufacture, easy to decorate, easy to use, and one that adapts itself to good sealing and retention functioning for use with various finishes. The closure provides easy optimization of seal and retention functions by the use of the two plastic materials, namely a hard cap shell and a resilient gasket having spaced-apart vertical ribs for engagement with the threads, the gasket and cap shell being advantageously held together against rotation by dovetail splines.

What is claimed is:

1. A closure for a container, the container comprising a neck finish area with tenerally helical threads, the closure comprising a cap having a top and a peripheral skirt of a hard, flexible thermoplastic material, a gasket member of resilient plastic located next to the shell of the cap, the gasket member including a skirt located just inside and concentric with the shell skirt, there being a plurality of ribs in the gasket material on the inside thereof for deformation around the threads of the container when the cap is closed over the threads, the area of the ribs being less than about 10% of the circumferential area of the gasket on the skirt, there being sufficient ribs spaced apart to adequately retain the cap on the container when subject to abuses from shipping and handling, the plastic gasket material and plastic cap shell being held together by vertical interlocking spline means on the cap skirt and the gasket skirt, the spline means being so constructed and arranged that the gasket member will not rotate with respect to the shell when the closure is twisted off the container, the spline means including a plurality of spaced apart vertical splines and vertical corresponding cooperating grooves.

2. A closure as defined in claim 1 in which the gasket member is in two pieces, one piece located substantially next to the top of the cap, and the other piece being along the skirt portion of the gasket member and containing the spaced-apart ribs for contact with the container.

3. A closure as defined in claim 1 in which the plastic shell has the hardness, flexibility, tensile modulus and tensile strength about equivalent to that of high density polyethylene, and the plastic gasket has a resiliency and deformability about equivalent to that of a flexible foamed polyvinyl chloride.

4. A closure as defined in claim 1 in which the plastic shell is made of high density polyethylene having a specific gravity melt flow index of about 0.6 and a crystallinity of about 65% to 75%.

5. A closure as defined in claim 1 in which the spline means includes splines in the cap shell and corresponding grooves in the gasket.

6. A closure as defined in claim 1 in which the spline means includes a plurality of splines in the gasket and corresponding grooves in the cap shell.

7. A closure for a container, the container comprising a neck finish area with generally helical threads, the closure comprising a cap having a top and a peripheral skirt of a hard, flexible thermoplastic material, a gasket member of resilient plastic located next to the shell of the cap, the gasket member including a skirt located just inside and concentric with the shell skirt, there being a plurality of ribs in the gasket material on the inside thereof for deformation around the threads of the container when the cap is closed over the threads, the area of the ribs being less than about 10% of the circumferential area of the gasket on the skirt, there being sufficient ribs spaced apart to adequately retain the cap on the container when subject to abuses from handling and shipping, the plastic gasket material and plastic cap shell being held together by vertical interlocking spline means on the cap skirt and the gasket skirt, the spline means beng so constructed and arranged that the gasket member will not rotate with respect to the shell when the closure is twisted off the container, the spline means including a plurality of spaced apart vertical splines and vertical corresponding cooperating grooves.

8. A closure as defined in claim 7 in which the gasket member is in two pieces, one piece located substantially next to the top of the cap, and the other piece being along the skirt portion of the gasket member, and the gasket member contains about 6 to 16 of the spaced-apart ribs for contact with the container.

9. A push-on twist-off plastic closure for a container having a generally threaded neck near a rim and an external generally cylindrical wall above the threads adjacent the rim, the closure comprising a one-piece thermoplastic shell including a top wall and a peripheral skirt, a gasket member of resilient plastic next to the shell, the gasket member including a top and a skirt located just inside and concentric with the shell skirt, the gasket skirt having means thereon for engaging the neck and threads of the container, the means including a plurality of spaced flexible thermoplastic resilient ribs integral with the skirt, each rib being so constructed and arranged that each rib deforms and cold flows to form a set corresponding groove therein when forced into contact with the container thread, the grooves being sufficient to provide enough purchase on the thread for removing the closure by twisting, the gasket member skirt and the shell skirt being held together by vertical interlocking spline means on the cap skirt and the gasket skirt, the spline means being so constructed and arranged that the gasket member will not rotate with respect to the shell when the closure is twisted off the container, the spline means including a plurality of spaced apart vertical splines and vertical corresponding cooperating grooves, an annular side sealing projection extending inwardly from the inside surface of the gasket skirt and having an internal surface dimension to form a side top seal with the external sealing wall of the container, and means on top wall of the gasket member for engaging the container rim to form a top seal.

10. A closure as defined in claim 9 in which the shell skirt has about six to sixteen spaced-apart splines and the plastic shell has a hardness, flexibility, tensile modulus, and tensile strength about equivalent to that of high density polyethylene and the gasket member has a resiliency and deformability about equivalent to that of flexible foamed polyvinyl chloride.

11. A closure for a container, the container comprising a neck finish area with generally helical threads, the closure comprising a cap having a top and a peripheral skirt of a hard, flexible thermoplastic material, a gasket member of resilient plastic located next to the shell of the cap, the gasket member including a skirt located just inside and concentric with the shell skirt, there being a plurality of ribs in the gasket material on the inside thereof for deformation around the threads of the container when the cap is closed over the threads, the area of the ribs being less than about 10% of the circumferential area of the gasket on the skirt, there being sufficient ribs spaced apart for sufficient torque to remove the cap from the container, the plastic gasket material and plastic cap shell being held together by vertical interlocking spline means on the cap skirt and the gasket skirt, the spline means being so constructed and arranged that the gasket member will not rotate with respect to the shell when the closure is twisted off the container, the spline means including a plurality of spaced apart vertical splines and vertical corresponding cooperating grooves.

12. A closure as defined in claim 11 in which the cross section of the rib is generally rectangular in form.

13. A closure as defined in claim 11 in which the cross section of the rib is generally triangular in form.

14. A closure as defined in claim 11 in which the top of the rib that engages the thread has a generally rounded shape.

15. A closure as defined in claim 11 in which there are splines in the cap shell.

16. A closure as defined in claim 11 in which there are cooperating grooves in the cap shell and splines in the gasket member.

* * * * *